US008069922B2

(12) United States Patent
Giem et al.

(10) Patent No.: US 8,069,922 B2
(45) Date of Patent: Dec. 6, 2011

(54) MULTIPLE ACTIVATION-DEVICE LAUNCHER FOR A CEMENTING HEAD

(75) Inventors: Greg Giem, Houston, TX (US); Philippe Gambier, Houston, TX (US); Joel Rondeau, Antony (FR); Chris Fitzgerald, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 12 days.

(21) Appl. No.: 12/417,126

(22) Filed: Apr. 2, 2009

(65) Prior Publication Data

US 2010/0084145 A1 Apr. 8, 2010

Related U.S. Application Data

(60) Provisional application No. 61/195,499, filed on Oct. 7, 2008.

(51) Int. Cl.
*E21B 33/13* (2006.01)
*E21B 33/05* (2006.01)

(52) U.S. Cl. ..... 166/291; 166/386; 166/75.15; 166/90.1; 166/70; 166/193

(58) Field of Classification Search ..... 166/291, 166/90.1, 193, 88.4, 89.1, 97.5, 386, 75.15, 166/90
See application file for complete search history.

(56) References Cited

U.S. PATENT DOCUMENTS 3,357,491 A * 12/1967 Jones et al. ..... 166/97.5
4,246,967 A * 1/1981 Harris ..... 166/291
4,624,312 A * 11/1986 McMullin ..... 166/155
4,809,776 A 3/1989 Bradley
RE33,150 E * 1/1990 Boyd ..... 166/242.5
4,890,357 A 1/1990 Pinto et al.
4,934,452 A 6/1990 Bradley
5,004,048 A 4/1991 Bode
5,095,988 A * 3/1992 Bode ..... 166/291
5,236,035 A * 8/1993 Brisco et al. ..... 166/70
5,343,968 A 9/1994 Glowka
5,544,705 A 8/1996 Jones et al.
5,722,491 A 3/1998 Sullaway et al.
5,762,139 A 6/1998 Sullaway et al.

(Continued)

FOREIGN PATENT DOCUMENTS

EP 0801704 B1 2/2003

(Continued)

OTHER PUBLICATIONS

Leugemors E, Metson J, Pessin J-L, Colvard RL, Krauss CD and Plante M: "Cementing Equipment and Casing Hardware," in Nelson EB and Guillot D (eds.): Well Cementing—2nd Edition, Houston: Schlumberger (2006): 343-434.

(Continued)

*Primary Examiner* — Jennifer H Gay
(74) *Attorney, Agent, or Firm* — Myron Stout

(57) ABSTRACT

A multiple activation-device launching system for a cementing head comprises a launcher body and at least one launching chamber that are sized to receive one or more activation devices therein. The activation devices are launched into the principal process-fluid stream inside the cementing head, and may be darts, balls, bombs, canisters and combinations thereof. The launching chambers are in fluid communication with an external power source for launching the activation device into the principal process-fluid stream.

5 Claims, 5 Drawing Sheets

U.S. PATENT DOCUMENTS

| | | | | |
|---|---|---|---|---|
| 5,787,979 | A | 8/1998 | Giroux et al. | |
| 5,829,523 | A | 11/1998 | North | |
| 5,890,537 | A | 4/1999 | Lavaure et al. | |
| 5,950,725 | A * | 9/1999 | Rondeau et al. | 166/70 |
| 5,960,881 | A | 10/1999 | Allamon et al. | |
| 6,009,944 | A | 1/2000 | Gudmestad | |
| 6,056,053 | A | 5/2000 | Giroux et al. | |
| 6,082,451 | A | 7/2000 | Giroux et al. | |
| 6,206,095 | B1 * | 3/2001 | Baugh | 166/70 |
| 6,237,686 | B1 | 5/2001 | Ryll et al. | |
| 6,244,350 | B1 | 6/2001 | Gudmestad et al. | |
| 6,279,654 | B1 | 8/2001 | Mosing | |
| 6,302,140 | B1 | 10/2001 | Brisco | |
| 6,360,769 | B1 | 3/2002 | Brisco | |
| 6,419,015 | B1 | 7/2002 | Budde et al. | |
| 6,491,103 | B2 | 12/2002 | Allamon | |
| 6,517,125 | B2 | 2/2003 | Brisco | |
| 6,520,257 | B2 | 2/2003 | Allamon | |
| 6,527,057 | B2 | 3/2003 | Fraser, III et al. | |
| 6,571,880 | B1 | 6/2003 | Butterfield, Jr. et al. | |
| 6,575,238 | B1 * | 6/2003 | Yokley | 166/75.15 |
| 6,597,175 | B1 | 7/2003 | Brisco | |
| 6,672,384 | B2 | 1/2004 | Pedersen et al. | |
| 6,755,249 | B2 | 6/2004 | Robison et al. | |
| 6,799,638 | B2 | 10/2004 | Butterfield, Jr. | |
| 6,802,372 | B2 | 10/2004 | Budde | |
| 7,040,401 | B1 * | 5/2006 | McCannon | 166/250.15 |
| 7,055,611 | B2 | 6/2006 | Pedersen et al. | |
| 7,093,664 | B2 | 8/2006 | Todd et al. | |
| 7,143,831 | B2 | 12/2006 | Budde | |
| 7,168,494 | B2 | 1/2007 | Starr et al. | |
| 7,172,038 | B2 | 2/2007 | Terry et al. | |
| 7,182,135 | B2 | 2/2007 | Szarka | |
| 7,249,632 | B2 | 7/2007 | Robichaux et al. | |
| 7,252,152 | B2 | 8/2007 | LoGiudice et al. | |
| 7,255,162 | B2 * | 8/2007 | Stevens et al. | 166/75.15 |
| 7,281,582 | B2 | 10/2007 | Robichaux et al. | |
| 7,281,589 | B2 * | 10/2007 | Robichaux et al. | 166/386 |
| 7,296,628 | B2 | 11/2007 | Robichaux et al. | |
| 7,353,879 | B2 | 4/2008 | Todd et al. | |
| 7,387,162 | B2 | 6/2008 | Mooney, Jr. et al. | |
| 7,503,398 | B2 | 3/2009 | LoGiudice et al. | |
| 7,537,052 | B2 * | 5/2009 | Robichaux et al. | 166/193 |
| 7,607,481 | B2 * | 10/2009 | Barbee | 166/291 |
| 7,841,410 | B2 * | 11/2010 | Barbee | 166/291 |
| 7,878,237 | B2 * | 2/2011 | Angman | 166/70 |
| 2004/0020641 | A1 | 2/2004 | Budde | |
| 2004/0231836 | A1 | 11/2004 | Budde | |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2006/0027360 | A1 * | 2/2006 | Basso | 166/177.4 |
| 2007/0068679 | A1 * | 3/2007 | Robichaux et al. | 166/381 |
| 2007/0158078 | A1 * | 7/2007 | Boyd | 166/380 |
| 2008/0053660 | A1 * | 3/2008 | Angman | 166/373 |
| 2008/0060811 | A1 | 3/2008 | Bour et al. | |
| 2008/0060820 | A1 | 3/2008 | Bour et al. | |
| 2008/0296012 | A1 * | 12/2008 | Peer et al. | 166/75.15 |
| 2010/0084145 | A1 * | 4/2010 | Giem et al. | 166/386 |

FOREIGN PATENT DOCUMENTS

| | | | |
|---|---|---|---|
| EP | 1540131 | A2 | 6/2005 |
| EP | 1903180 | A1 | 3/2008 |
| EP | 2009227 | A1 | 12/2008 |
| FR | 2663678 | A1 * | 12/1991 |
| WO | 9848143 | A1 | 10/1998 |
| WO | 2004011770 | A2 | 2/2004 |
| WO | 2005052311 | A1 | 6/2005 |
| WO | 2005108738 | A1 | 11/2005 |
| WO | WO 2007016313 | A2 * | 2/2007 |

OTHER PUBLICATIONS

Piot B and Cuvillier P: "Primary Cementing Techniques," in Nelson EB and Guillot D (eds.): Well Cementing—2nd Edition, Houston: Schlumberger (2006): 459-500.

* cited by examiner

MULTIPLE ACTIVATION-DEVICE LAUNCHER FOR A CEMENTING HEAD

This application is a conversion from and claims benefit of a provisional application 61/195,499, filed on Oct. 7, 2008.

BACKGROUND OF THE INVENTION

The statements in this section merely provide background information related to the present disclosure and may not constitute prior art.

The invention is related in general to equipment for servicing subterranean wells. The invention relates to a deepsea cement head that is intended to drop a combination of darts, balls, bombs and canisters in order to activate downhole equipment, launch cementing plugs, deliver chemical products, or the like.

Existing tools implement a modular design with darts that are preloaded in baskets within the modules. The modules are connected to one another using clamps. The darts are held in place mechanically and released by removing the mechanical obstruction and redirecting the flow of the pumped fluid through the dart basket. The darts are then pumped through the tool by the fluid. The first dart to be launched is placed in the lowest module, with subsequent darts passing through the baskets vacated by the earlier darts.

Darts in prior designs are launched by blocking the bypass flow of the process fluid and forcing the fluid through the dart chamber. The dart forms an initial seal when placed into the basket. When fluid enters the dart chamber, pressure builds and breaks the seal, forcing the dart out of the basket, through the tool and into the main process-fluid stream.

Some prior art designs consist of modules similar to those described in U.S. Pat. Nos. 4,624,312 and 4,890,357. The darts are loaded from the topmost module, through the swivel if necessary, and pushed down to their respective baskets with a long rod. The modules have valves that are used to select between the dart and the bypass flow. The valve itself serves as the mechanical obstruction that prevents the dart from prematurely launching. When the valve is turned, it simultaneously opens a passage for the dart while closing the passage of the bypass flow.

It remains desirable to provide improvements in wellsite surface equipment in efficiency, flexibility, and reliability.

SUMMARY OF THE INVENTION

The present invention allows such improvement.

In a first aspect, the present invention relates to a multiple activation-device launching system for a cementing head, comprising a launcher body comprising at least one launching chamber, the launching chamber sized to receive one or more activation devices therein, the launching chamber in fluid communication with a power source for launching the activation device into the principal process-fluid stream.

In another aspect, the present invention aims at a method for deploying one or more activation devices into a process-fluid system into a process-fluid system utilizing an angled launching system for a cementing head comprising a launcher body comprising a primary valve and at least one launching chamber, the launching chamber equipped with a secondary valve and sized to receive one or more activation devices therein, the launching chamber in fluid communication with a power source for launching one or more activation devices into the principal process-fluid stream.

In a further aspect, the present invention pertains to a method for deploying one or more activation devices into a process-fluid system utilizing an angled launching system for a cementing head comprising a launcher body comprising at least one launching chamber and a device chamber, the launching chamber sized to receive one or more activation devices therein, the launching chamber in fluid communication with an external power source for launching one or more activation devices into the principal process-fluid stream.

An embodiment of the invention comprises a single activation-device launcher module that contains multiple launching chambers arranged at an angle relative to the main axis of the tool. The activation devices may be darts, balls, bombs or canisters. The devices are loaded into their respective chambers directly or in a cartridge, but directly from the open air rather than through the length of the tool. A variety of methods can be used to launch the activation devices. The activation devices may also contain chemical substances that, upon exiting the launching chamber, are released into the well.

The advantages of the general implementation of the embodiment is that more activation devices may be fit into a shorter length tool, simplifying the loading process, and making the baskets more accessible for maintenance purposes. This allows to easily maintaining the tool on the rig when the system from the art can only be serviced at the district.

In another embodiment of the invention, the system may comprise any number of launching chambers (at least one, but preferably two, three, four or more), each with an axis at an angle relative to the main axis of the tool. The chamber(s) may be positioned at the same level, or a different level (e.g. in spiral, or stages). When the activation devices are forced out of the chamber(s), they enter the main body of the tool in the correct orientation and are swept away by the pumped fluid (hereafter called process fluid) to serve their intended purpose. The exact number of chambers is not essential, indeed, multiple unique launching methods that will work independently from the arrangement of the launching chambers are contemplated.

In a preferred embodiment, the activation devices are launched with process-fluid power as the motive power. Each launching chamber is preferably linked to the main flow of process fluid using a small pipe, hose, or integral manifold. A valve (primary valve) blocks the main flow on command, diverting the fluid into the launching chambers. Each launching chamber would comprise a valve (secondary valve) that alternately allows or blocks the flow of fluid into the corresponding launching chamber. All valves may be manually or remotely actuated. In a launch procedure, all secondary valves are initially closed, the primary valve is initially open. To launch an activation device, the operator opens the secondary valve corresponding to the activation device's chamber and then closes the primary valve. Once the activation device is successfully ejected from the launching chamber, the primary valve is reopened and the launch procedure is repeated for launching additional activation devices.

In another embodiment, external fluid power is used to launch the activation devices from their chambers. The external fluid power employed to force the activation device from its chamber may comprise water or fluid connected directly behind the activation device; a hydraulic cylinder with a rod that forces the dart out of its chamber, a hydraulic piston without a rod that seals within the launching chamber (activation device on one side, external fluid on the other), a bladder behind the activation device that fills from an external fluid source pushing the activation device out of the chamber, or a similar type of fluid power as will be appreciated by those skilled in the art.

Although the disclosed launching system is mainly being presented in the context of well cementing, it will be appreciated that the process-fluid stream could comprise other well fluids including, but not limited to, drilling fluids, cement slurries, spacer fluids, chemical washes, acidizing fluids, gravel-packing fluids and scale-removal fluids.

BRIEF DESCRIPTION OF THE DRAWINGS

FIGS. 1A-1D depict a dart, a ball, a canister and a bomb, respectively, occupying the launching chamber.

DETAILED DESCRIPTION

Figure 1A:
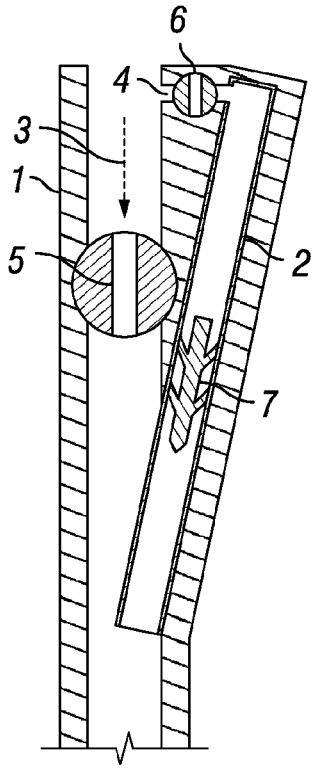
FIGS. 1A-1D are conceptual views of a multiple activation-device launcher that employs valves to divert process-fluid flow to the launching chamber, forcing an activation device to exit the launching chamber.
Figure 1B:
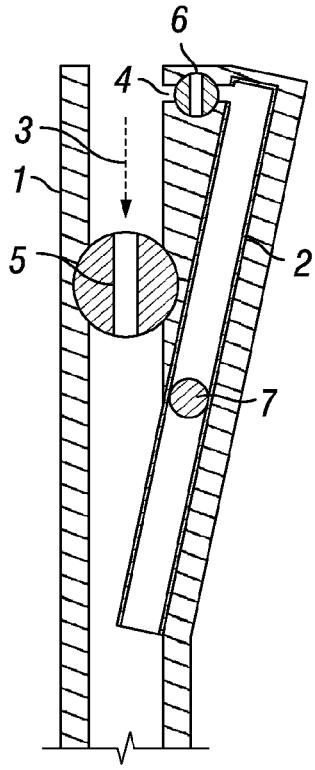
Figure 1C:
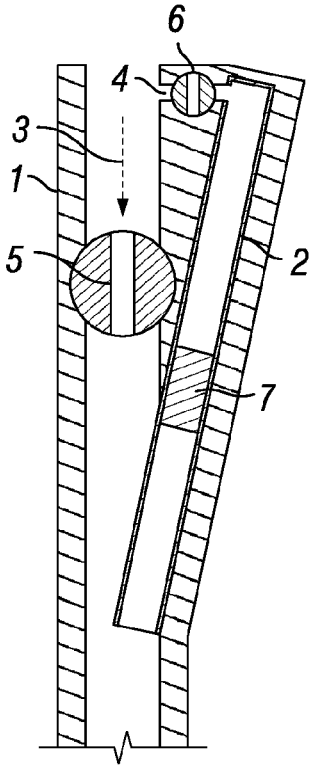
Figure 1D:
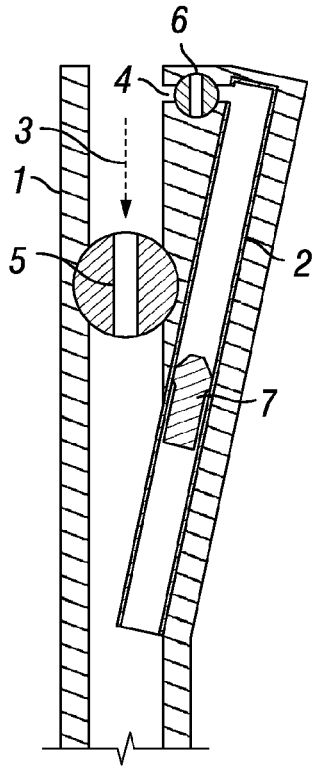

According to a preferred embodiment, the invention involves the diversion of process-fluid flow from the principal flow stream through the launcher body to one of the launching chambers. Referring to FIGS. 1A-1D, the launcher module comprises two principal elements—the launcher body 1 which is the primary conduit through which the process fluid flows; and one or more launching chambers 2 containing one or more activation devices 7 and connected to the primary conduit. Activation devices are launched by closing the primary valve 5, which diverts process-fluid flow from the principal flow direction 3 into the conduit 4 connecting the main body to the launching chambers. Each launching chamber shall be equipped with a secondary valve 6 that allows or blocks process-fluid flow into the chamber. When the secondary valve is opened, and process fluid flows into the launching chamber, the activation device is pushed out of the launching chamber and into the principal process-fluid stream. The activation device 7 may be a dart (FIG. 1A), a ball (FIG. 1B), a canister (FIG. 1C) or a bomb (FIG. 1D).

The primary valve preferably needs only to withstand enough differential pressure to force the activation device from the launching chamber. The primary valve may be a plug valve, a butterfly valve, a balloon-shaped bladder that inflates from the center to seal the main fluid passage, a doughnut-shaped bladder that inflates from the edges to seal the main fluid passage, a pressure-operated rubber component similar to those used in BOPs or inflatable packers or similar type valve, as will be appreciated by those skilled in the art.

The secondary valves may be any variety of on-off valves, but are preferably designed to be easily removed and cleaned after repeated exposure to particle-laden fluids such as cement slurry. The secondary valve may be a plug valve, a butterfly valve, a balloon-shaped bladder that inflates from the center to seal the main fluid passage, a doughnut-shaped bladder that inflates from the edges to seal the main fluid passage, a pressure-operated rubber component similar to those used in BOPs or inflatable packers, or similar type valve as will be appreciated by those skilled in the art.

Figure 2:
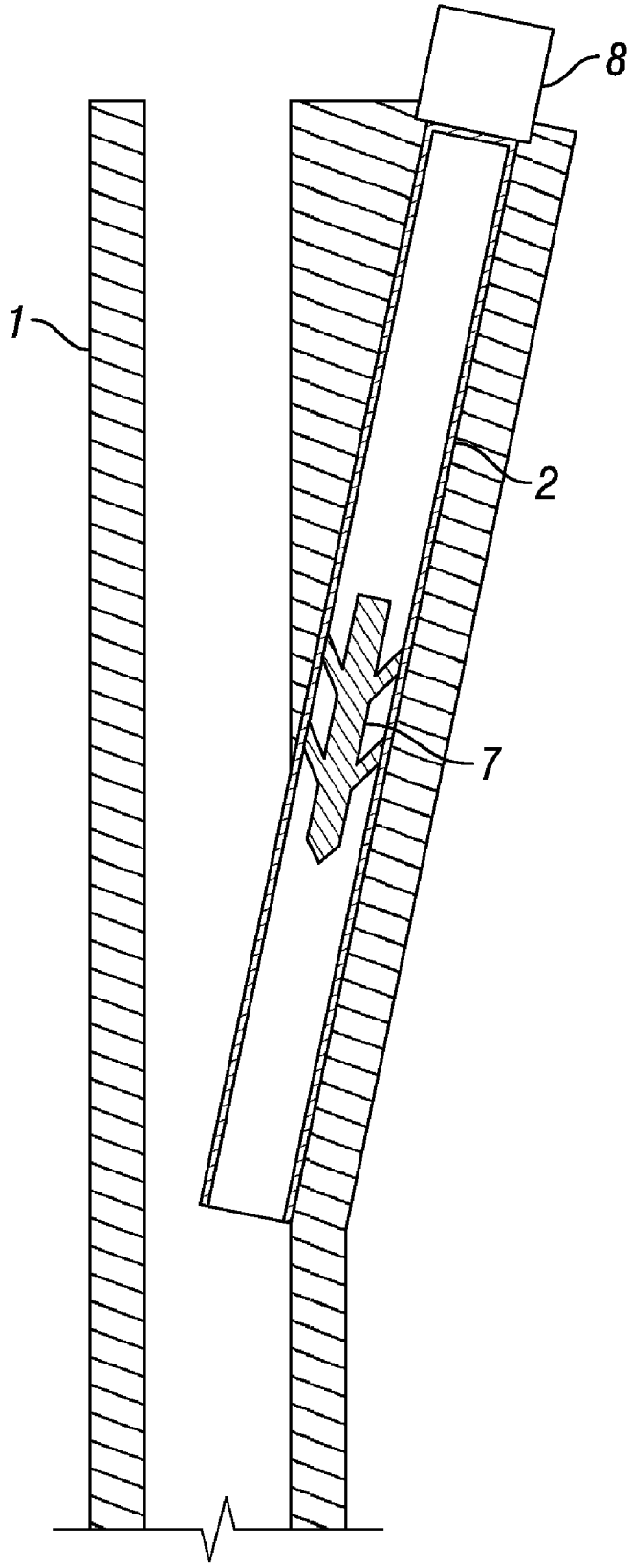
FIG. 2 is a conceptual view of a multiple activation-device launcher featuring an external power source that, when energized, forces the activation device to exit the launching chamber.

In another embodiment, shown in FIG. 2, an external device 8 forces the one or more activation devices from the launching chamber 7. Several types of external power are envisioned.

Figure 3:
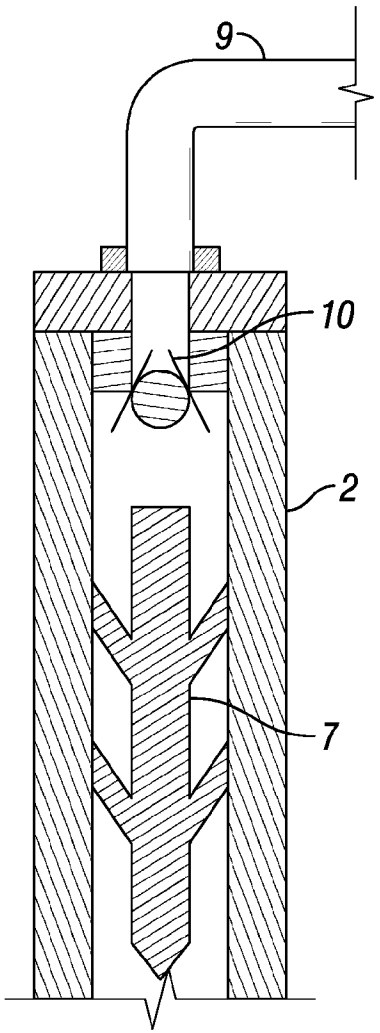
FIG. 3 is a conceptual view of a multiple activation-device launcher employing a fluid as the external power source.

As shown in FIG. 3, water or fluid connected directly behind the activation device may be used to expel the device from its chamber. The fluid is not directly connected to the main process fluid. A hydraulic line 9 conveys the fluid to the launching chamber 2. The operator opens a one-way valve 10, allowing the fluid to flow into the launching chamber and carry the activation device 7 out of the launching chamber and into the main process-fluid flow.

Figure 4:
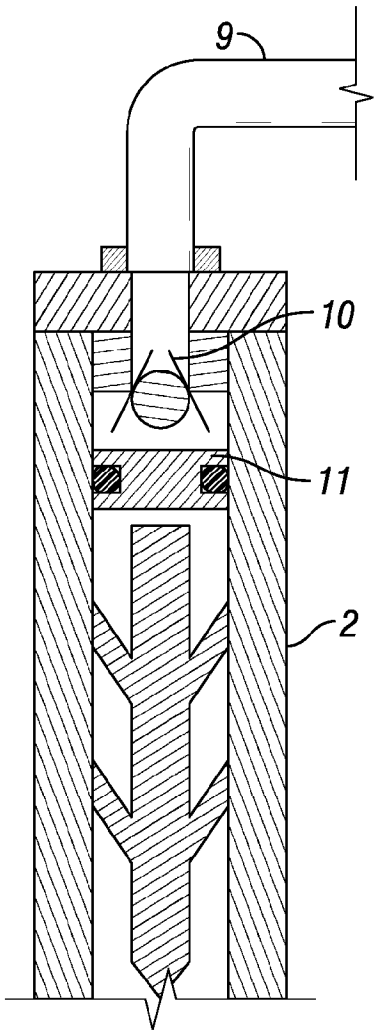
FIG. 4 is a conceptual view of a multiple activation-device launcher employing a piston as the external power source.

As shown in FIG. 4, a hydraulic line 9 conveys fluid to the launching chamber 2. After the operator actuates the one-way valve 10, the fluid enters the launching chamber and forces a piston 11 to move and push the activation device 7 out of the launching chamber and into the main process-fluid flow.

Figure 5:
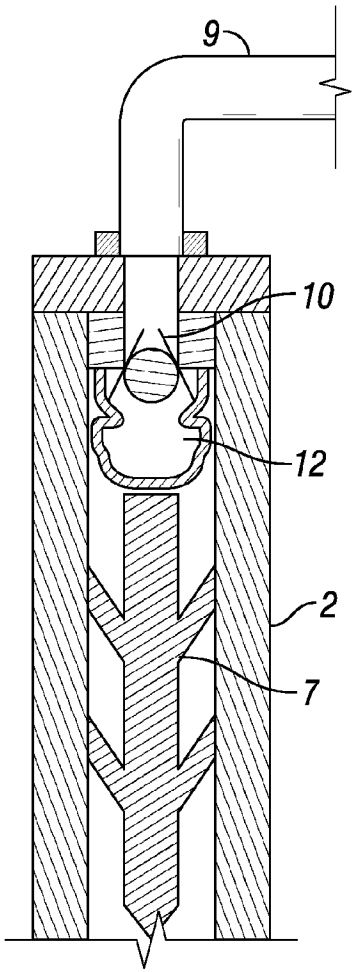
FIG. 5 is a conceptual view of a multiple activation-device launcher employing an inflatable bladder as the external power source.

As shown in FIG. 5, a hydraulic line 9 conveys fluid to the launching chamber 2. After the operator actuates the one-way valve 10, the fluid enters the launching chamber and inflates a bladder 12. As the bladder inflates, it pushes the activation device 7 out of the launching chamber and into the main process-fluid flow.

Figure 6:
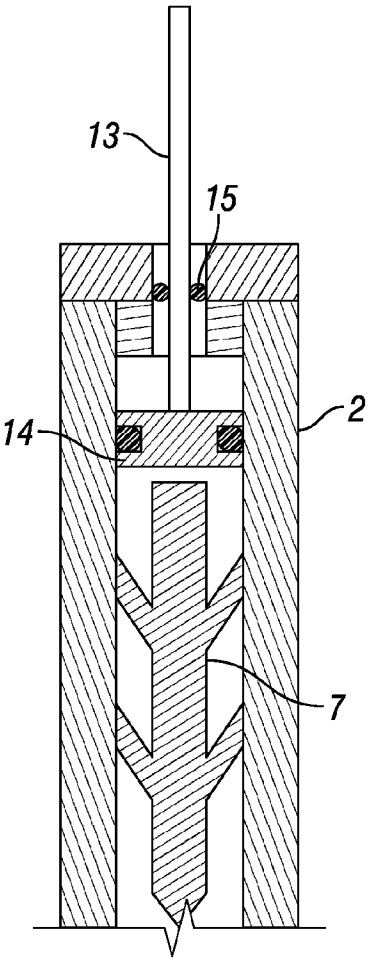
FIG. 6 is a conceptual view of a multiple activation-device launcher employing a rod and piston as the external power source.

As shown in FIG. 6, a hydraulic rod 13 extends out of the upper portion of the launching chamber 2, and is connected to a piston 14 inside the launching chamber. A hydraulic seal 15 isolates the inner and outer portions of the launching chamber. The operator pushes the rod further into the launching chamber, causing the piston to force the activation device 7 out of the launching chamber and into the main process-fluid flow.

Figure 7:
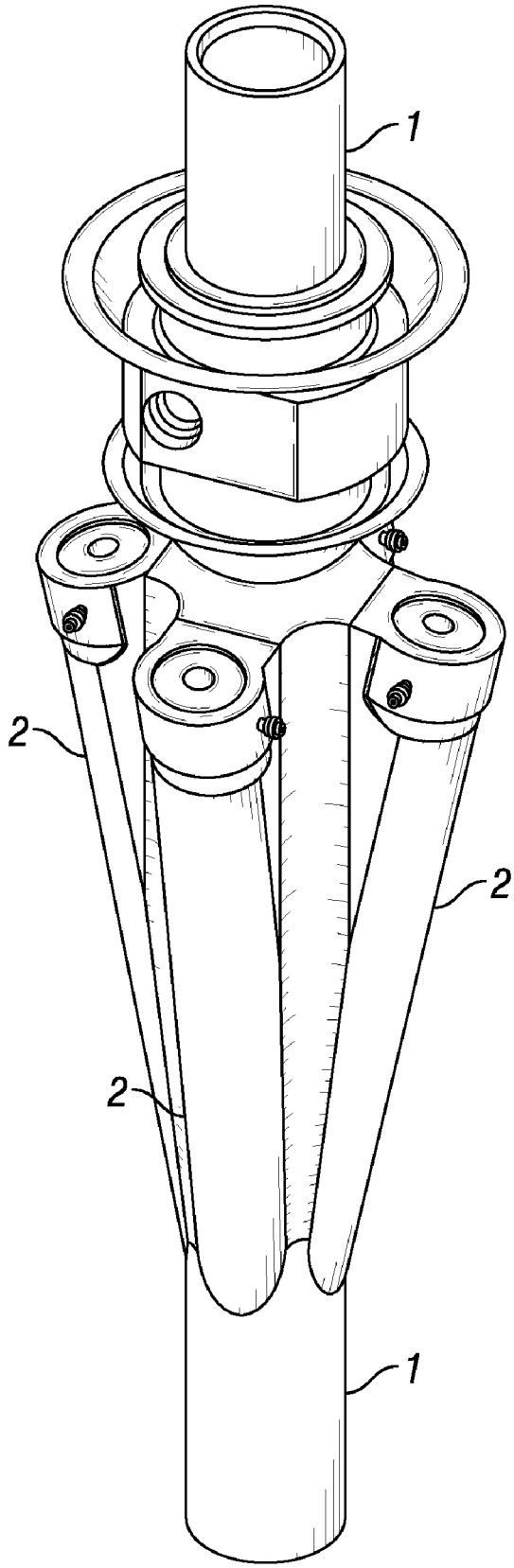
FIG. 7 is an external view of the invention featuring multiple launching chambers.

FIG. 7 is an external view of the present invention with multiple launching chambers.

The activation device depicted in FIGS. 2-7 is a dart; however, as shown in FIGS. 1A-1D, activation devices may also include balls, bombs and canisters.

The activation devices may be filled with a chemical substance that, upon release from the launching chamber, is dispensed from the activation device into the process fluid. The chemical release may occur at any time after the activation device is launched-from the moment of launching to any time thereafter. Delayed chemical release may be performed for a number of reasons including, but not limited to, avoiding fluid rheological problems that the chemical would cause if added during initial fluid mixing at surface, and triggering the initiation of chemical reactions in the fluid (e.g., cement-slurry setting and fracturing-fluid crosslinking) at strategic locations in the well.

The process fluid may comprise one or more fluids employed in well-service operations. Such fluids include, but are not limited to, drilling fluids, cement slurries, spacer fluids, chemical washes, acidizing fluids, gravel-packing fluids and scale-removal fluids.

The present invention also comprises a method of operating the multiple activation-device launcher depicted in FIG. 1 comprising inserting one or more activation devices 7 in at least one of the launching chambers 2, and closing the secondary valves 6 in each of the launching chambers. Process fluid is then pumped through the launcher body 1. When it is time to release an activation device 7, the primary valve 5 is closed and the secondary valve 6 is opened in the launching chamber of choice. This diverts process-fluid flow through the launching chamber 2, forcing the activation device 7 to exit into the launcher body 1. After the activation device 7 is launched, the secondary valve 6 is closed, the primary valve 5 is reopened to restore process-fluid flow through the launcher body 1, and the activation device 7 is carried to its destination. This process is then repeated until a sufficient number of activation devices have been deployed to complete the treatment. One or more activation devices may contain a chemical substance that is released to the process fluid after deployment into the process fluid.

In another embodiment, the present invention pertains to a method of operating the multiple activation-device launcher depicted in FIG. 2 comprising inserting one or more activation devices 7 in at least one of the launching chambers 2, and connecting the chambers to an external power source 8. Power sources include, but are not limited to, a fluid connected directly behind the activation device 7 (FIG. 3), a hydraulic cylinder 14 with a rod 13 (FIG. 6), a hydraulic piston 11 without a rod (FIG. 4), and an inflatable bladder 12 (FIG. 5). Process fluid is pumped through the launcher body 1. When it is time to release an activation device 7, the external power source 8 is activated, forcing the activation device 7 to exit into the launcher body 1. This process is then repeated until a sufficient number of activation devices have been deployed to complete the treatment. One or more activation devices may contain a chemical substance that is released to the process fluid after deployment into the process fluid.

The methods of operating the multiple activation-device launcher depicted in FIGS. 1 and 2 may further comprise activation devices containing a chemical substance that is released after the activation device exits the launching chamber. The activation device may begin dispensing the chemical substance immediately upon launching, or at any time thereafter.

In the methods of operating the multiple activation-device launcher depicted in FIGS. 1 and 2, the process fluid may comprise one or more fluids employed in well-service operations. Such fluids include, but are not limited to, drilling fluids, cement slurries, spacer fluids, chemical washes, acidizing fluids, gravel-packing fluids, scale-removal fluids. In addition, the activation devices may comprise darts, balls, bombs and canisters.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A multiple activation-device launching system for a cementing head, comprising a launcher body that comprises at least three unblocked launching chambers, the launching chambers sized to receive one or more activation devices therein, each launching chamber in fluid communication with a hydraulic piston without a rod that seals the launching chamber, wherein the activation devices comprise one or more members of the list comprising: darts, bombs and canisters.

2. The system of claim 1, wherein each of the launching chambers is arranged at an angle relative to the axis of the launcher body, and the launching of the activation devices is independent of process-fluid flow.

3. The system of claim 1, wherein at least one activation device is filled with a chemical substance, and the chemical substance is released after launching.

4. A method for deploying one or more activation devices into a process-fluid stream comprising:

(i) providing a multiple activation-device launching system for a cementing head, comprising a launcher body that comprises at least three unblocked launching chambers, each launching chamber sized to receive one or more activation devices therein, each launching chamber in fluid communication with a hydraulic piston without a rod that seals the launching chamber;

(ii) installing the launching system on the cementing head;

(iii) installing at least one activation device into at least one launching chamber;

(iv) connecting each launching chamber to a fluid source that is independent of the process-fluid stream; and (v) causing the piston to move through the launching chamber, thereby injecting one or more activation devices into the process-fluid stream, wherein the activation-devices comprise one or more members of the list comprising: darts, bombs and canisters.

5. The method of claim 4, wherein:

i. one or more activation devices is filled with a chemical substance; and ii. the chemical substance is released into the process fluid after launching.

* * * * *